United States Patent [19]

Ikesue

[11] 4,339,854

[45] Jul. 20, 1982

[54] BUCKLE ASSEMBLY FOR SEAT BELT

[75] Inventor: Haruyuki Ikesue, Fujisawa, Japan

[73] Assignee: NSK-Warner K.K., Tokyo, Japan

[21] Appl. No.: 118,208

[22] Filed: Feb. 4, 1980

[30] Foreign Application Priority Data

Feb. 5, 1979 [JP] Japan ..... 54-12809[U]
Feb. 5, 1979 [JP] Japan ..... 54-12810[U]

[51] Int. Cl.[3] ..... A44B 11/25
[52] U.S. Cl. ..... 24/230 AL
[58] Field of Search ..... 24/230 A, 230 AP, 230 AK, 24/230 AL, 230 AS, 230 AA

[56] References Cited

U.S. PATENT DOCUMENTS

| | | | |
|---|---|---|---|
| 3,522,640 | 8/1970 | Lohr | 24/230 R |
| 4,065,836 | 1/1978 | Stephenson | 24/230 A |
| 4,078,248 | 3/1978 | Hill | 362/100 |
| 4,094,046 | 6/1978 | Takada | 24/230 AK |
| 4,096,606 | 6/1978 | Stephenson | 24/230 A |
| 4,136,425 | 1/1979 | Esner | 24/230 A |
| 4,196,499 | 4/1980 | Tolfsen | 24/230 A |
| 4,206,533 | 6/1980 | Meiller et al. | 24/230 AK |
| 4,237,586 | 12/1980 | Morinaga | 24/230 AK X |

*Primary Examiner*—Roy D. Frazier
*Assistant Examiner*—Peter A. Aschenbrenner
*Attorney, Agent, or Firm*—Shapiro and Shapiro

[57] ABSTRACT

The buckle assembly includes a cover member, a base member, a latch member movably supported by the base member, and latch member operating means. The latch member is slidable in a direction normal to a tongue inserting direction between a tongue latching position and a tongue unlatching position, and the latch member operating means comprises a push button slidable in a direction parallel to the tongue inserting direction and a lever member rotatable about a axis normal to both of the tongue inserting and latch member sliding directions, so that a sliding movement of the push button may cause a movement of the latch member from the tongue latching position to tongue unlatching position, through a rotational movement of the lever member.

8 Claims, 11 Drawing Figures

BUCKLE ASSEMBLY FOR SEAT BELT

BACKGROUND OF THE INVENTION

1. Field of the Invention

The present invention relates to a buckle assembly for seat belt.

2. Description of the Prior Art

Many types of buckle assemblies for seat belt have been already known and used. All of the known buckle assemblies have the same basic structure comprising a tongue and a latch device for latching the tongue. Generally, the latch device comprises a base member, a latch member, means for operating the latch member and means for covering the members and means. The latch member is normally biased toward the position in which the latch member latches the tongue. For this purpose, bias means is provided within the base member. As the operation means, there is used usually a push button which is directly engaged with the latch member. Because of the direct engagement with the latch member, the mounting position of the push button is limited. It must be positioned near the latch member. Since the push button is operated by fingers or the like, it is desirable that the exposed surface of the push button be located in a position most convenient for finger operation by the person wearing the seat belt, or that the push button be designed to have a larger exposed surface for the convenience of button operation or that there be a space where illuminating means for the push button may be provided. However, for the reason mentioned above, freedom in location and design of the push button is limited extremely in the known assemblies.

Another disadvantage of the known assembly is found in the manner of operation of the latch member. In the known buckle assembly, force applied to the push button is almost directly used to operate the latch member. Releasability of latch is not so good and therefore the buckle assembly must be further improved in this respect.

SUMMARY OF THE INVENTION

Accordingly, it is one object of the invention to provide a buckle assembly for seat belt which permits freedom of design to improve the operability and releasability of a latch device.

Further, it is another object of the invention to provide a buckle assembly for seat belt provided with means for illuminating a push button.

Other and further objects, features and advantages of the present invention will appear more fully from the following description of embodiments with reference to the accompanying drawings, wherein:

DESCRIPTION OF THE PREFERRED EMBODIMENTS

Figure 1:
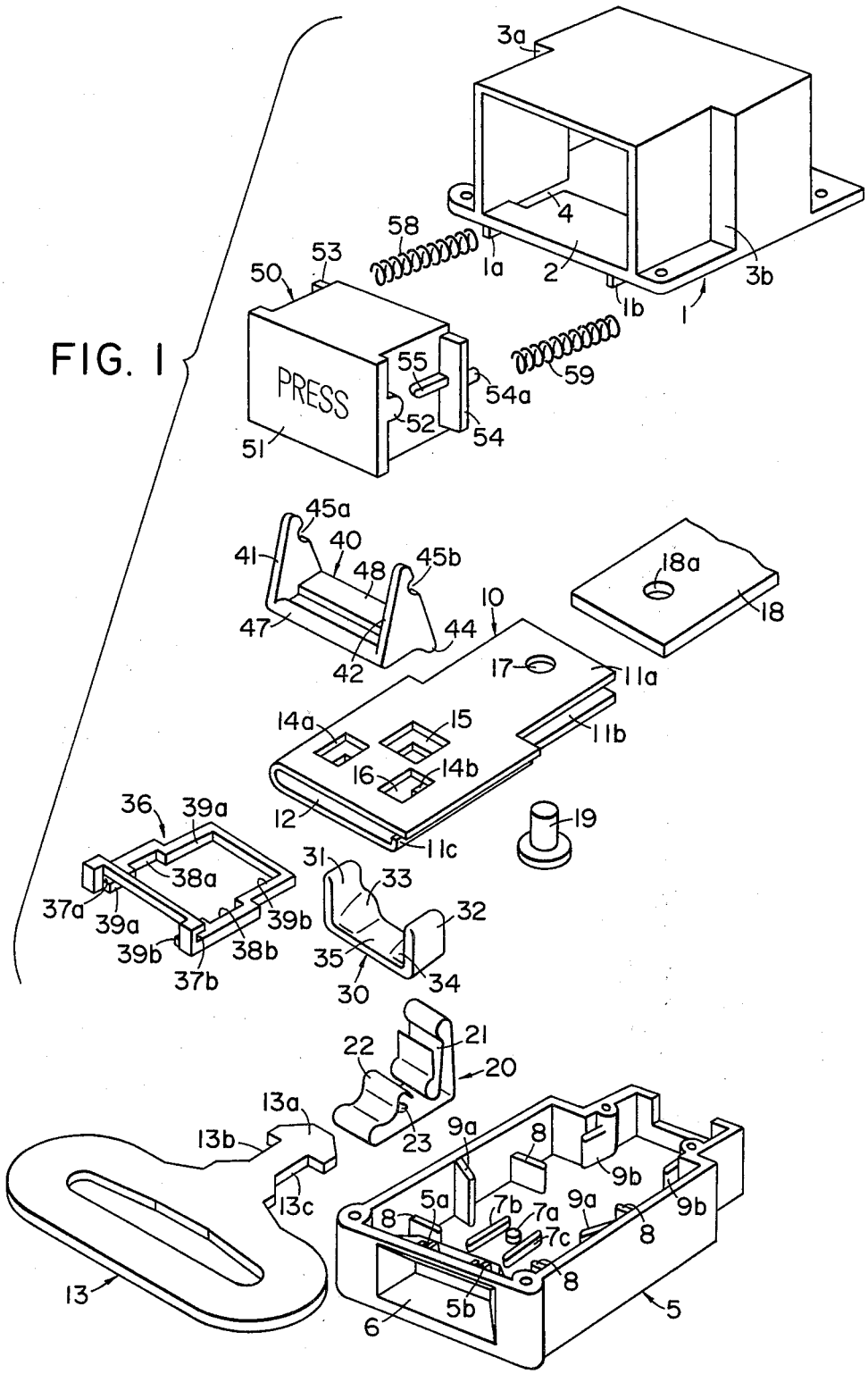
FIG. 1 is an exploded perspective view of one embodiment of the buckle assembly for seat belt of the invention.

All of the members shown in FIG. 1 with the exception of tongue 13 constitute together the latch device of a buckle assembly for seat belt according to the invention.

The latch device includes upper and lower cover members 1 and 5. When the two cover members are joined together, they form a hollow chamber for receiving other various members hereinafter described. At the front side (left side as viewed in the drawing of FIG. 1), the upper cover member 1 has an opening 2 for operating the push button and the lower cover member 5 has an opening 6 for inserting the tongue. The two openings are vertically aligned with each other so that the direction in which the tongue is inserted is in parallel with the direction in which the push button is slide moved.

Within the lower cover member 5 there are provided projections 8 serving as a support for a base member 10 of which description will be made later. In assembling, the base member is laid on the projections 8. In the lower cover member there are provided also other projections designated by 9*a* and 9*b* which are disposed to contact with the wide part of the base member and the transition part from the wide part to the narrow part of the same member for preventing the base member 10 from playing longitudinally and laterally.

The base member 10 is made of a sheet of metal which is so folded as to form two parallel flat plates 11*a* and 11*b* with a space 12 for tongue insertion being provided therebetween. Therefore, when the base member is fixed in place, the space 12 is communicated with the tongue insertion opening 6 at its fore end and has a thickness enough to receive and guide the tongue 13. In the shown embodiment, to assure a smooth and stable guidance of the tongue 13, a tongue guide 36 made of resin material is used in the space 12 of the base member 10. The tongue guide eliminates lateral play of the tongue when the latter is inserted. The tongue guide serves also to assure a smooth and stable vertical movement of the latch member 30. To perform these functions, the tongue guide 36 has recesses 37*a*, 37*b* engageable with the fore end portion of the upper flat plate 11*a* of the base member 10 to fix the guide 36 at its place, surfaces 39*a*, 39*b* for guiding the tongue and surfaces 38*a*, 38*b* for guiding the latch member.

The base member 10 has a hole 17 at its rear portion passing through the two parallel flat plates 11*a* and 11*b*.

An iron plate 18 serving as a connecting member is inserted into the space 12 up to the position in which the hole 18*a* of the plate 18 is in alignment with the hole 17 of the base member 10. In this position, a rivet 19 is driven in the holes to join the two member together. Thus, the base member is connected with the body of vehicle or other suitable part of vehicle through the iron plate 18. For connection of the base member 10 with the vehicle body or other part, there may be used any suitable connecting means other than the iron plate connecting member. For example, the connection may be made by using webbing, flexible wire or the like. In the upper flat plate 11*a* of the base member 10 are provided with three square holes 14*a*, 14*b* and 15. Of these square holes two holes 14*a* and 14*b* near the front edge of the plate are disposed laterally aligned with each other to guide the latch member. The remaining one 15 is behind the two holes 14*a* and 14*b* and in the middle of the width of the plate. As later described, a vertical standing portion of a leaf spring 20 is loosely fitted in the square hole 15. On the other hand, the lower flat plate 11*b* has a larger hole 16 in the area corresponding to the above three square holes in the upper plate 11*a*. The hole 16 has a shape just as formed by combining the three holes 14*a*, 14*b* and 15 together. As indicated by 11*c* the side edge of the lower flat plate 11*b* of the base member 10 is curved upwardly to prevent any deviation of the tongue guide 36 from the space 12.

The latch member generally designated by 30 is vertically slide movably received in the above described holes 14*a*, 14*b* and 16 provided in the base member. The latch member 30 has two side parts 31 and 32 extending vertically and a connection part 35 connecting the two side parts at their lower ends. Thus, the latch member 30 is formed as a U-shaped member. The latch member 30 is under the action of bias force of the leaf spring 20, more particularly, of the fold-back portion 22 of the spring intending to move the locking member upward.

The leaf spring 20 comprises a horizontal base part having a round hole 23 therein, a vertical part 21 and a fold-back part 22. As mentioned above, the fold-back part 22 has a function to bias the latch member 30 and the vertical part 21 serves to spring the tongue 13 out. To fix the base part of the leaf spring in its place, a round projection 7*a* formed on the inner surface of the lower cover member 5 is engaged in the round hole 23 and two parallel rib-like projections 7*b* and 7*c* hold the base part at its both sides.

The two corner portions contiguous to the two side parts 31 and 32 protrude upwardly to form latching parts 33 and 34. Each of the latching parts 33 and 34 has a sloped cam portion and a vertical rear end surface serving as an anchoring surface for tongue. The tongue 13 inserted passing through the opening 6 come in the latch member 30. In the latch member, the tip end 13*a* of the inserted tongue 13 at first comes into contact with the sloped cam portions and presses the latch member down. Since the latch member 30 is moved downward in this manner, the tongue 13 is allowed to further advance inward. After the tip end 13*a* of the tongue has passed the cam portions, the cutout parts 13*b* and 13*c* come to the positions just above the latching parts 33 and 34 respectively. At this time point, since the latch member is released from the pushing-down pressure by the tongue, the latch member 30 is moved back upwardly under the action of the fold-back part 22 of the leaf spring 20. As a result, the tongue 13 gets latched by the rear vertical anchoring surface portions of the latching parts 33 and 34.

The push button generally designated by 50 is received in the opening 2 and slide movable in a direction parallel to the tongue inserting direction.

The push button 50 comprises an exposed surface part 51, flange parts 53, 54 and projections 52, 54*a* and 55. The push button is operated by pushing the exposed surface part 51 with fingers or the like. The flanges 53 and 54 abut against the inner surfaces of the lateral walls 3*a* and 3*b* of the upper cover member 1 respectively to prevent the push button 50 from jumping out of the cover member 1. Projections 54*a*, 54*a* (only one is visible in the drawing) receive coil springs 58 and 59 biasing the push button 50 toward the front. The rearward extending projections 52, 52 (only one is visible) are disposed to engage with a lever member 40 of which description will be made later, and to rotate the lever member. Projections 55, 55 (only one is visible) extend forward and serve to prevent chattering of the lever member 40.

The lever member 40 is provided to transmit the motion of the push button 50 to the latch member 30. The lever member comprises a rotation shaft part 47 about which the lever is rotated, two side surface parts extending nearly normally to the shaft part at the both ends of the shaft part and a bridge part 48 extending between the two side surface parts to reinforce the lever member.

The two side surface parts have engagement portions 41 and 42 disposed to engage with the above described projections 52, 52 of the push button, engagement portions 44, 44 (only one is visible) disposed to engage with the top portions of the latch member's side parts 31, 32 and recesses 45*a*, 45*b* for loose engagement with projections 55, 55 of the push button 50 respectively. The shaft part 47 of the lever member is fitted in between the corner portions 5*a* and 5*b*, (second supporting means) formed on the front part of the lower cover member 5 and the two downward projections 1*a* and 1*b*, (first supporting means) extending from the bottom surface of the upper cover member 1 (see FIG. 2). Since the lever member is supported at its shaft part 47 in this manner, the shaft part extends at right angles with both of the tongue inserting direction and the latch member sliding direction and is firmly held without any idle movement. In addition, the two side surface parts of the lever member 40 are engaged in the guide slits 4, 4 (only one is seen on the drawing) formed at the both sides of the front part of the upper cover member 1, which enhances the stability in motion of the lever member.

In the last step of assembly, the upper and lower cover members 1 and 5 supporting and covering the above described members are joined together by screws passing the screw holes provided at the four corners of each the cover member. Fastening means for the cover members is never limited to screws only. Other suitable fastening means also may be used.

The manner of operation of the above described embodiment is as follows.

Figure 2:
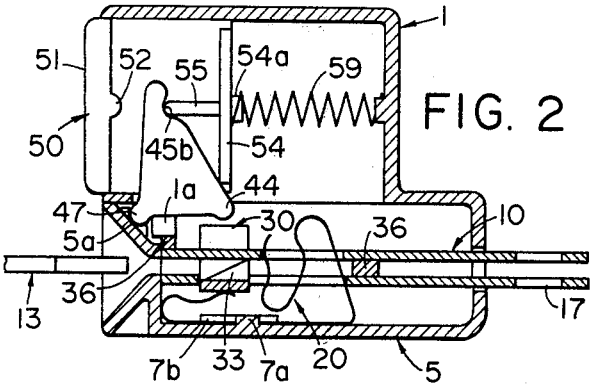
FIG. 2 is a sectional view of the buckle assembly of FIG. 1.

In the unlatched position shown in FIG. 2, the latch member 30 is in the position upwardly slide moved by the action of the leaf spring 20. Since the push button 50 is in the position forwardly slide moved by the biasing force of the coil springs 58 and 59, the projections 55, 55 of the push button are in engagement with the recesses 45*a* and 45*b* respectively so that the lever member 40 has already been rotated counter-clockwise about its shaft part 47. Therefore, latching portions 33 and 34 of the latch member 30 are in the space 12 between the two parallel flat plates of the base member 10 beyond the level of opening 16 formed in the lower flat plate 11*b*.

Figure 3:
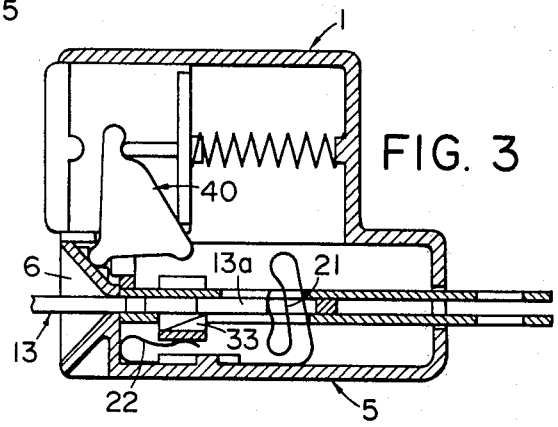
FIG. 3 is a view similar to FIG. 2 of the buckle assembly of the invention with the tongue inserted therein.
Figure 4:
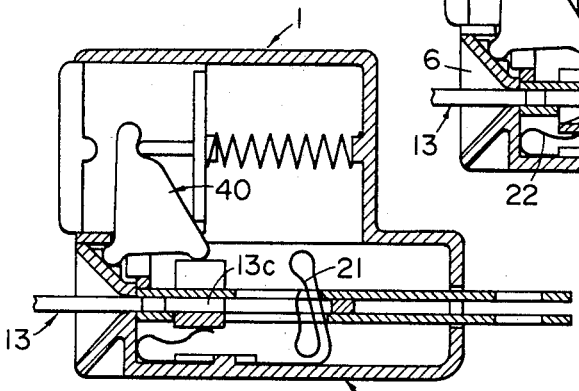
FIG. 4 is a view similar to FIG. 2 of the buckle assembly of the invention with the tongue assembled therein.

In the above position, the tongue 30 may be inserted into the latch device through the tongue insertion opening 6 as shown in FIG. 3. At the first stage of the tongue insertion, the tongue tip end 13*a* comes into contact with the sloped cam portions and presses the latter down. As a result, the latch member 30 is slide moved downward against the spring force of the leaf spring 20. At the next stage of the tongue insertion, the tongue cutout portions 13*b* and 13*c* reach the position in which they are just above the latching parts 33 and 34 of the latch member. At this moment, the latch member 30 is released from the pressure by the tongue. Therefore, the latch member jumps up owing to the restoring force of the fold-back part 22 of the leaf spring 20. Now, the tongue 13 gets latched by the anchoring end surfaces of the latching parts 33 and 34. This latched position is shown in FIG. 4. In this position, the vertical portion 21 of the leaf spring 20 is compressed rearward by the tip end 13*a* of the tongue and therefore a restoring force is stored in the leaf spring. In the positions shown in FIGS. 2 through 4, projections 55 of the push button 50 are kept engaged in the recesses 45*a* and 45*b* of the lever member 40 to support the lever motionlessly. Therefore, no unpleasant chattering noise is generated even when the latch device oscillates.

Figure 5:
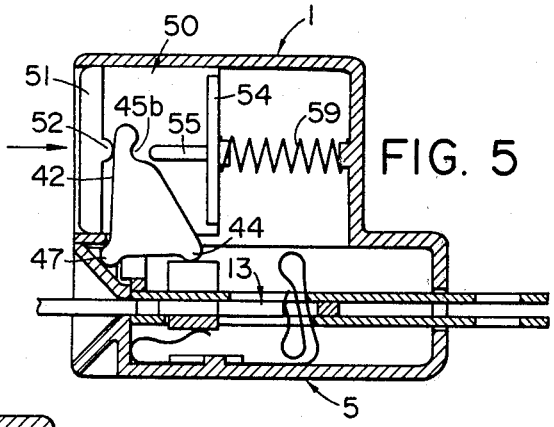
FIG. 5 is a view similar to FIG. 4 of the buckle assembly of the invention with the push button half slid to the release condition.
Figure 6:
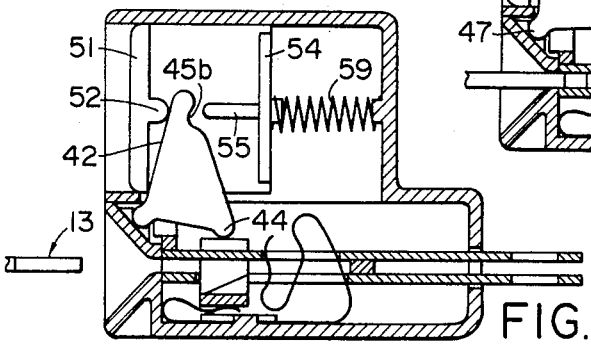
FIG. 6 is a view similar to FIG. 4 of the buckle assembly of the invention with the push button completely slid to the release condition.

The tongue can be released from the above latched condition by pushing the push button 50 in the direction of arrow in FIG. 5. By pushing the push button against the bias force of the coil springs 58 and 59, the projections 55 will be disengaged from the recesses 45*a* and 45*b* of the lever member 40. At the same time, projections 52, 52 come into engagement with the engaging portions 41 and 42 to rotate the lever member clockwise. With the clockwise rotation of the lever member 40, its portions 44 come into engagement with the latch member 30. As a result, the latch member is pushed down against the force of the leaf spring 20. As the latch member 30 is moved downward in this manner, the latching parts 33 and 34 are also lowered and finally moved down up to the position in which their vertical rear end anchoring surfaces are apart from the tongue and in a level lower than the level of the underside surface of the tongue. At this time point, the tongue gets free and it is allowed to spring out from the tongue insertion opening by the spring force of the vertical portion 21 of the leaf spring 20. Thereafter, the push button 50, lever member 40 and locking member 30 will be returned back to their starting positions shown in FIG. 2. Thus, unlatching operation of the buckle assembly is completed. The amount of force required to effect unlatching can be changed by changing the ratio of the distance from shaft part 47 to engaging part 41, 42 to the distance from shaft part 47 to engaging part 44 of the lever member 40.

According to the above embodiment, assembly of the latch device can be made in a very simple manner only by placing the parts on the lowermost member one by one. Assembly can be carried out also by mounting the push button 50, coil springs 58, 59 and lever member 40 into the upper cover member 1 while mounting the leaf spring 20, latch member 30, base member 40 and the like into the lower cover member 5 at first and then joining the two cover members together.

As will be understood from the foregoing, the present invention broadens freedom of location and size of the push button and enables to provide a buckle assembly for seat belt having improved operability. This is advantageous in particular when the latch device is to be embeded in the console box of a vehicle or the like. Further, this is advantageous when the latch device needs to have an illuminating means for illuminating the push button.

There will hereinafter described embodiments with the illuminating means of the invention.

Figure 7:
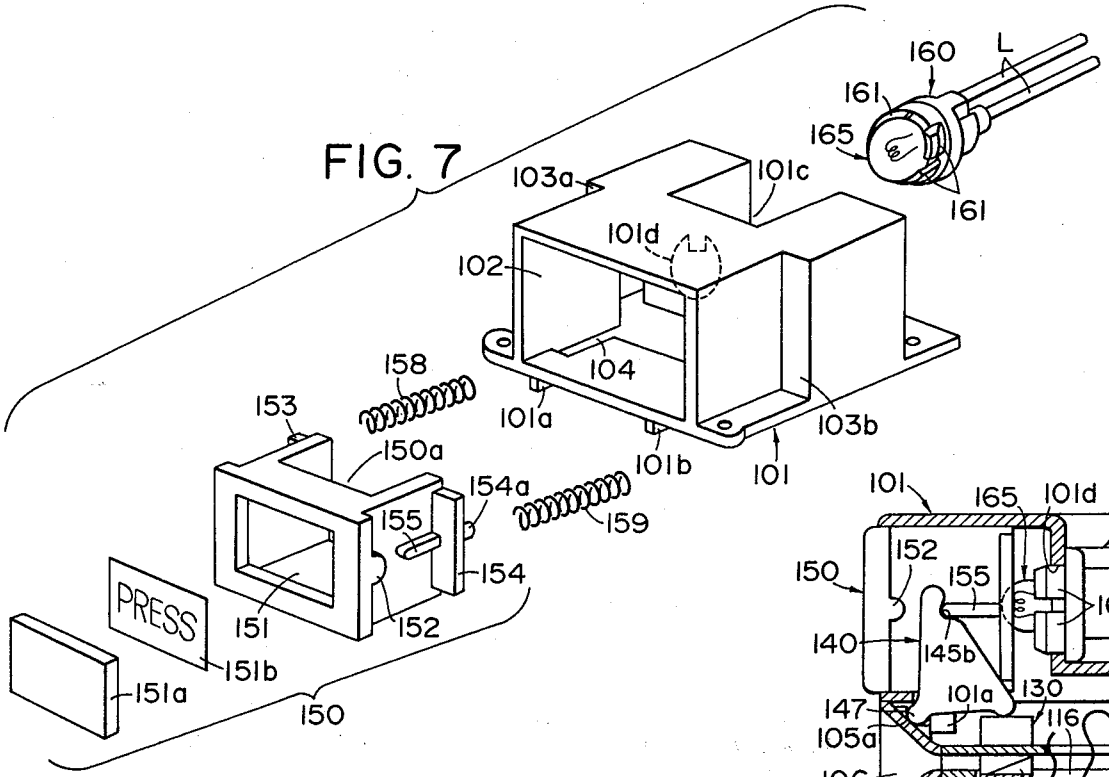
FIG. 7 is a portional exploded perspective view of one embodiment of the buckle assembly for seat belt with the illuminating means of the invention.

Referring to FIG. 7 in which members common to the embodiment already explained are omitted, a push button generally designated by 150 is so designed to be received in the opening 102 of the upper cover member 101 slide movably in the direction parallel to the direction in which the tongue is inserted. The push button comprises a main body having a rectangular front opening 151, a letter marked plate 151*b* and a transparent plate 151*a*. The two plates are fixed to the main body in such manner as to close the opening 151. The main body of push button 150 is generally in a box-like shape and its top and rear sides are left open to define an open part 150*a*. The main body has a pair of flanges 153 and 154 which abut against the inner surfaces of the walls 103*a* and 103*b* laterally projected from the upper cover member 101 respectively. The flanges serve as stopper to prevent the push button 150 from sliding out forwardly. Coil springs 158 and 159 are received by projections 154*a* (only one of the two projections is visible in the drawing) provided on the flanges. The coil springs bias the push button toward the front. The main body has also other projections 152 and 155 at its both sides although those at one side are visible in the drawing. The projection 152 projecting rearwards is disposed to come into engagement with a lever member 140 later described to rotate the lever. The other projection 155 projecting forwards is disposed to stabilize the lever member 140.

The letter marked plate 151*b* is light transmissive only at the letter portion and intransmissive at the remaining portion so that the letter portion may be seen brightly in the dark by the light coming from the open part 150*a*. Alternatively, the letter marked plate 151*b* may be formed to be light transmissive at the non-letter portion and intransmissive at the letter portion so that the dark letter can be seen on the light background.

The open part 150*a* is provided for the following reason.

It is desirable to position illumination means near the front surface of the push button 150 as close as possible. To this end, the rear part of the upper cover member 101 is cut out as indicated by 101*c* and a hole 101*d* for mounting the illumination means is formed in the receded wall portion. Because of the recess 101*c* the open part 150*a* is required. To insert the push button 150 into the button operation opening 102 its upper side must be left open at the part 150*a*.

Means for illuminating the push button comprises a lamp 165 with a socket 160 connected to an electric source through a lead L. The illumination means is fitted to the buckle assembly by snapping the socket 160 into the mounting hole 101*d* in the upper cover member 101 by means of spring portion 161 provided on the socket. Of course, the spring portion 161 for snap fitting may be substituted by a screw portion for screw fixing or a click for click stop. Thus, illumination means is made as one unit which can be mounted in and removed from the buckle assembly as desired by a simple manual operation.

The brief manner of operation of the above described embodiment is as follows.

Figure 8:
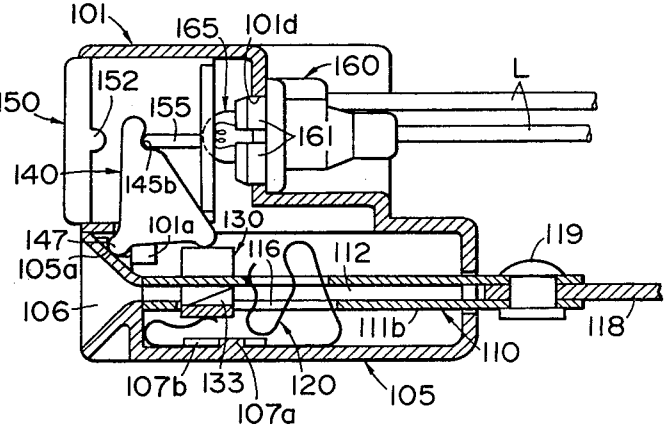
FIG. 8 is a sectional view of the buckle assembly with the illuminating means of FIG. 7.

FIG. 8 shows the latch device in its unlatched position and there common members to the first embodiment are designated by numerals which are made by corresponding numerals and a hundred. In this position, the latch member 130 is in the position upwardly slid by the action of leaf spring 120.

The lamp 165 has to be kept On at least during the time of the assembly being in the latched position. This may be achieved in various ways. For example, the lamp may be connected in such manner that turning-on of the lamp can be effected simultaneously with turning-on of light for the gage board of the vehicle. In another way, the lamp may be connected in such manner that it can be turned on by insertion of the tongue 13 and turned off by unlatching the tongue. Other possibilities may be easily thought out by those skilled in the art. Further, the lamp 165 of illuminating means may be turned off while the tongue is unlatched or it may be remained on.

Figure 9A:
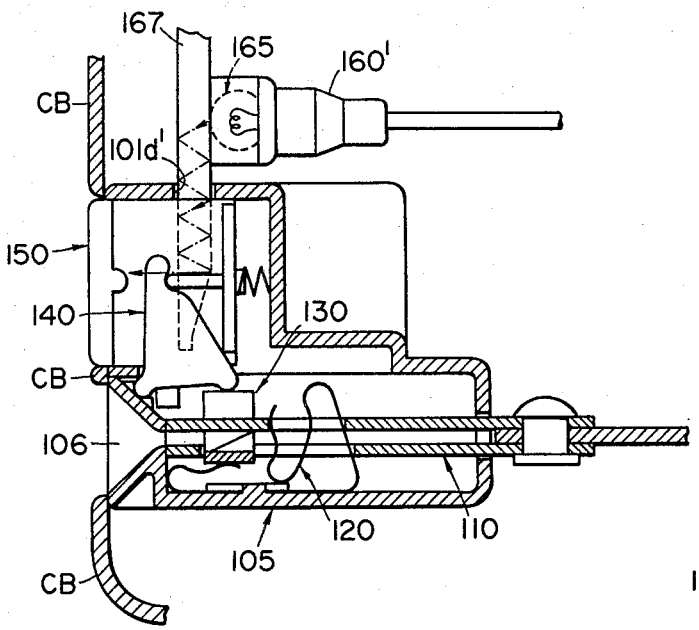
FIG. 9A is a sectional view of another embodiment of the buckle assembly for seat belt with the illuminating means of the invention.

FIG. 9 shows another embodiment with the illuminating means of the invention.

Figure 9B:
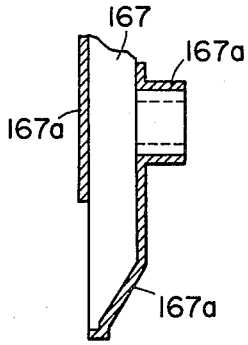
FIG. 9B is a sectional view of a modification of the light guide means used in the buckle assembly with the illuminating means of FIG. 9A.

In this embodiment, a mounting hole 101*d* for illumination means is provided in the upper side surface of the upper cover member 101. Light emitted from the lamp 165 socketted in a socket 160' is guided through a transparent resin lens member 167 so as to illuminate the front surface of the push button 150 from the backside of the front surface as indicated by a chain-dotted line in FIG. 9A. To achieve a more effective guidance of illumination light, the lens member 167*a* may be partly covered with a shading layer of light intransmissive material 167*a* as shown in FIG. 9B.

In the embodiment shown in FIG. 9, the latch device is embeded in the console box CB of the vehicle with only the front surface of the push button 150 and the tongue insertion opening 106 being exposed to the exterior. Other arrangement of this embodiment is essentially the same as that previously described with reference to FIGS. 7 and 8.

In the buckle assembly according to the invention, illumination means for the push button can be mounted in or removed from the assembly in a simple manner from the exterior of the cover means. Among others, the above described embodiments in which a portion of illumination means is exposed to the exterior are particularly suitable for the case where the assembly is embeded in a console box CB in use. For removable mounting of illumination means, it is also possible to fix the lens member 167 while the socket 160' being removably mounted.

Figure 10:
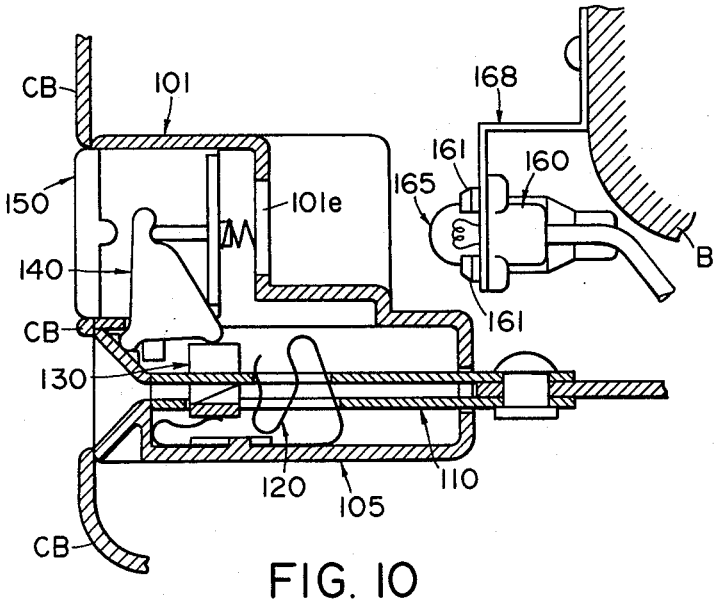
FIG. 10 is a sectional view showing a modification of the illuminating means.

FIG. 10 shows a modification of the above two embodiment to be embeded in a console box CB.

In this modification, illumination means comprising a socket 160 and a lamp 165 is removably mounted on a mount 168 fixed to the body floor B. Light emitted from the lamp 165 can reach the front surface of the push button 150 passing through a window 101*e* formed in the rear wall of the upper cover member 101. In other respects, the arrangement of this modification is essentially the same as that of the embodiment described with reference to FIGS. 7 and 8.

While the light source of illumination means has been shown and described as a lamp, other light source also may be used in the invention. For example, LED, that is, light emitting diode may be used in place of lamp. Similarly, light from the light source may be introduced also into the tongue insertion opening to illuminate there in the dark in addition to the push button. In this case, it is required to keep the light source On in both of unlatched position and latched position of the buckle assembly.

It is to be understood that the buckle assembly for seat belt herein disclosed and described is presented for the purpose of explanation and illustration and is not intended to indicate limits of the invention the scope of which is defined by the following claims.

What I claim is:

1. A buckle assembly for seat belt including:

cover means comprising a first cover member having a push button operation opening therein and first supporting means adjacent to the push button operation opening, and a second cover member having a tongue insertion opening therein and second supporting means adjacent the tongue insertion opening, said cover means being disposed to form a hollow chamber in communication with said two openings;

a latch member movable in a direction normal to a tongue inserting direction between tongue latching position and tongue unlatching position and being normally biased toward said tongue latching position;

a base member mounted in said second cover member, said base member extending in the tongue inserting direction to form a tongue guide passage in communication with said tongue insertion opening and movably supporting said latch member; and latch member operating means disposed within said cover means and being always biased to take a condition in which said operating means has no effect on said latch member, said latch member operating means including a push button mounted in said first cover member for sliding in a direction parallel with the tongue inserting direction, and a lever member disposed rotatably about an axis extending normally to both of the tongue inserting direction and latch member sliding direction, the lever member being supported between said first and second supporting means, and said lever member having a first engaging portion for engagement with said push button and a second engaging portion for engagement with said latch member, whereby a sliding motion of said push button against said bias causing, through a rotational movement of said lever member, a movement of said latch member from the tongue latching position to tongue unlatching position.

2. A buckle assembly for seat belt including:

cover means disposed to form a tongue insertion opening, a push button operation opening and a hollow chamber in communication with said two openings;

a latch member movable in a direction normal to a tongue inserting direction between tongue latching position and tongue unlatching position and being normally biased toward said tongue latching position;

a base member mounted in said second cover member, said base member extending in the tongue inserting direction to form a tongue guide passage in communication with said tongue insertion opening and movably supporting said latch member; and latch member operating means disposed within said cover means and being always biased to take a condition in which said operating means has no effect on said latch member, said latch member operating means including a push button mounted slideably in a direction parallel with the tongue inserting direction, and a lever member disposed rotatably about an axis extending normally to both of the tongue inserting direction and latch member sliding direction, and said lever member having a first engaging portion for engagement with said push button and a second engaging portion for engagement with said latch member, whereby a sliding motion of said push button against said bias causing, through a rotational movement of said lever member, a movement of said latch member from the tongue latching position to tongue unlatching position, the assembly further including push button illuminating means adapted to be kept on at least during the time of said latch member being in the tongue latching position to illuminate a manual operating portion of said push button from inside of said cover means, said illuminating means being removably mounted to said cover means.

3. A buckle assembly for seat belt according to claim 1 or 2, wherein said push button and lever member have separate means which can cooperate to hold said lever member in a stable state while said push button and lever member are in the condition in which they have no effect on said latch member.

4. A buckle assembly for seat belt according to claim 2, wherein said cover means comprises a first cover member having said push button operation opening therein and a second cover member having said tongue insertion opening therein, and said buckle assembly is assembled by joining said two cover members together after mounting said push button and lever member in said first cover member and said latch member and base member in said second cover member.

5. A buckle assembly for seat belt according to claim 2, wherein said illuminating means includes light guide means for guiding light from a light source to a place directly inside of said manual operating portion of said push button.

6. A buckle assembly for seat belt according to claim 2, wherein said illuminating means illuminates said tongue inserting opening as well.

7. A buckle assembly for seat belt according to claim 2, wherein said cover means has, in its wall, a hole for mounting said illuminating means.

8. A buckle assembly for seat belt according to claim 2, wherein said push button has an indication for indicating said manual operating portion thereon, one of said indication and a portion of said manual operating portion where the indication is not presented substantially passes the light therethrough, and the other of said indication and said portion substantially interferes with the light's passing therethrough.

* * * * *